US006189354B1

(12) United States Patent
Späth

(10) Patent No.: US 6,189,354 B1
(45) Date of Patent: Feb. 20, 2001

(54) METHOD AND MODULAR-MULTISTATION DEVICE FOR FOLDING PROFILES

(75) Inventor: Walter E. Späth, Stein am Rhein (DE)

(73) Assignee: Suban AG, Lucerne (CH)

( * ) Notice: Under 35 U.S.C. 154(b), the term of this patent shall be extended for 0 days.

(21) Appl. No.: 09/214,028

(22) PCT Filed: Apr. 23, 1998

(86) PCT No.: PCT/EP98/02418

§ 371 Date: Jan. 25, 1999

§ 102(e) Date: Jan. 25, 1999

(87) PCT Pub. No.: WO98/48957

PCT Pub. Date: Nov. 5, 1998

(30) Foreign Application Priority Data

Apr. 25, 1997 (DE) ..... 197 17 472

(51) Int. Cl.[7] ..... B21D 7/08; B21D 9/10

(52) U.S. Cl. ..... 72/31.07; 72/171; 72/173; 72/150; 72/158

(58) Field of Search ..... 72/171, 173, 175, 72/150, 157, 158, 219, 164, 170, 247, 31.07, 31.05

(56) References Cited

U.S. PATENT DOCUMENTS

| | | | | |
|---|---|---|---|---|
| 1,533,443 | * | 4/1925 | Miller | 72/157 |
| 2,988,127 | * | 6/1961 | Gray | 72/155 |
| 3,168,129 | * | 2/1965 | Henry | 72/307 |
| 3,921,424 | * | 11/1975 | Pearson | 72/158 |
| 4,718,265 | | 1/1988 | Post | 72/219 |
| 5,115,658 | * | 5/1992 | Kirchhoff | 72/175 |
| 5,226,305 | * | 7/1993 | Adleman | 72/157 |
| 5,345,803 | * | 9/1994 | Cutter | 72/157 |
| 5,379,624 | * | 1/1995 | Harman | 72/150 |
| 5,499,521 | * | 3/1996 | Luikart | 72/157 |
| 5,617,754 | * | 4/1997 | Senft | 72/247 |

FOREIGN PATENT DOCUMENTS

| | | | | |
|---|---|---|---|---|
| 0492211 | | 7/1992 | (EP) . | |
| 507029 | * | 6/1945 | (GB) | 72/164 |

* cited by examiner

*Primary Examiner*—Daniel C. Crane
(74) *Attorney, Agent, or Firm*—Brown, Martin, Haller & McClain, LLP

(57) ABSTRACT

The invention relates to a method and multistation device for folding profiles. The folding stations (1, 11, 15, 16, 17) required are modules mounted interchangeable and adjustable on a common machine body (2), which permits quick and simple adaption to the folding requirements. It is thus possible, with one single machine, to implement a whole series of folding processes. With regard to the machine operation, such stations are selected as needed, fitted and set depending on folding criterion.

23 Claims, 15 Drawing Sheets

METHOD AND MODULAR-MULTISTATION DEVICE FOR FOLDING PROFILES

Figure 1:
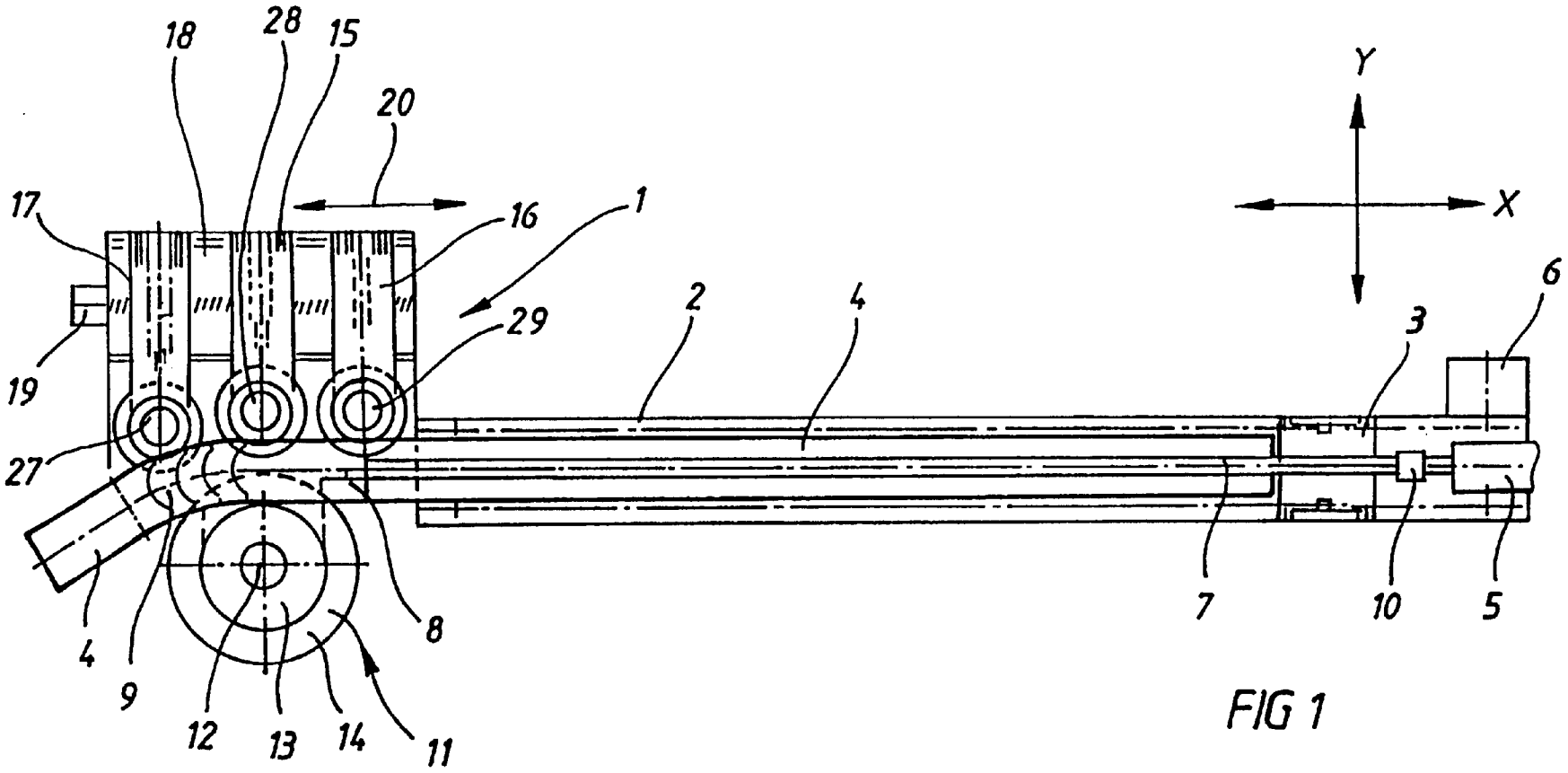

This application is a 371 of PCT/EP98/02418, filed Apr. 23, 1998.

The submitted invention concerns itself with a method and a device to bend metal sections (in particular hollow sections) according to the preamble of patent claim 1.

Such a method has become known, for example, with the object of the EP 492 211. The essence of this known method is, that two rollers opposite each other form a rolling gap, through which the section to be bent is fed by means of a driving force, whereby the bending then occurs because of the rotary drive of the opposing bending rollers in connection with the effective forward thrust. In addition, there are, with the known arrangement, still more guided rollers opposing each other, which are intended to prevent bulges and nicks of the section to be bent.

The disadvantage of the known method is, that it requires an expensive thrust station which uses a high thrusting force (in the range of several tons), to feed the section to be bent in between the rotationally driven bending rollers in order to achieve a required shape.

The assigned rollers are hereby not movably arranged in the X-direction (longitudinal direction of the section to be bent), but they are stationary on a machine bed. Thereby there is the disadvantage that we are dealing with a closed design machine, which cannot be modified or combined. If it is necessary to use another method of bending or to bend in a different way, it is necessary to design a completely new machine, which is very expensive to do.

Therefore, it is the task of the submitted invention to advance a method and a device for the bending of hollow metal sections, according to the preamble of the patent claim 1, in such a manner that a universal machine will be created, making it possible to interchange individual bending stations, to completely remove or rearrange them, with the goal of creating universally applicable bending machine.

The solution of this task is accomplished through the technical concept of claim 1.

An essential feature of this invention is, that the total roller bending station consists of separate roller stations, of which each roller station has at least one roller, which is placed against the section to be bent and that each roller station is assigned a different bending task and that in addition each roller station is modularly exchangeable and is arranged so that each one is adjustable and removable from a common machine body. In addition, a mandrel can be provided on the inside of the section for the purpose of support.

With the given technical concept, the essential advantage is that a completely modular construction of the total bending machine is presented. It shall also be mentioned, that the bending machine at hand is not only suited for bending of closed hollow metal sections, but that these hollow sections can be partially or totally open. With all bending processes it is always important, that in the (possibly also partially open) hollow space, a ball mandrel or a mandrel shank is brought along, which is kept stationary within the range of bending, so that the hollow section to be bent is optimally supported within the range of bending and is protected against bulges, nicks or against any other kind of deformation.

With the given modular construction, the essential advantage that a universally applicable bending machine is obtained, so that with this bending machine a number of different banding tasks can be accomplished, without the necessity,—as is the case at the present state of technology—of having to design and build a completely new machine with different processing capabilities.

The essence of the invention is, the modular construction, whereby a number of roller stations are arranged in an adjustable and engaging manner on a common machine body. It is preferable to arrange the individual roller stations adjustably on so-called X/Y-slides, whereby it is sufficient for individual roller stations to only allow an adjustment in the Y-direction, while an adjustment in the X-direction is not applicable.

In the first preferred design of the invention, a so-called roller-bending is planned (bending left or right), in such a way that on one side of the hollow section to be bent in the X-Y direction, there are positioned next to each other and at mutually adjustable distances, a bending station, a guide- and rolling station and a support station. Each of the named stations has at least one roller, whereby it is left open whether all rollers are rotationally driven or not. In one preferred design, it is planned that the roller of the bending station (bending roller) is not rotationally driven, while the rolling- and guide roller of the guide- and rolling station is rotationally driven and the support roller of the support station is also not rotationally driven.

It is important, that opposite to this construction there is a center roller station arranged, which consists of a single, rotationally driven center roller, which is exchangeable and which can be replaced by other rollers of different diameters and shapes. This exchangeability also applies to the other above-mentioned rollers.

Herewith it is then important that, for example, the center roller of the center roller station, as arranged on an assigned slide, is only adjustable in the Y-direction so that the adjustment in the X-direction is not required. Conversely, the three roller stations mentioned above (bending station, support station and guide- and rolling station) are designed to be adjusted in the X-Y-direction. In this manner, it is now possible for the first time, to effect a left bending and a right bending, because with the so-called left-bending of a section, when viewed from the top, the three mentioned roller stations are positioned above, while the center roller station is positioned below. If, on the other hand, a section is supposed to be bent to the right, there occurs the opposite arrangement whereby the three mentioned stations are positioned below and the center roller station is positioned above.

It is important, that the three mentioned stations which engage on one side of the section to be bent, can also be understood as a module in themselves and that this total module, consisting of the three mentioned stations, can be simply drawn out of the machine bed and reintroduced and secured on the opposite side.

It is also possible, because of the modular construction, to interchange the entry side of the total roller bending station with the exit side of the same roller bending station, in order to achieve right or left bending.

In an analog fashion, this is also applicable for the interchanged placement of the center roller station which is positioned on the lower side on the machine bed, when bending left and on the opposite side (upper), when bending right.

In a further development of the submitted invention, it is planned, that there will also be so-called alternate bending; with this design the advantage of a modular construction of the invented machine is again demonstrated. Here it is planned that the three previously-mentioned roller stations have arranged on the opposite side, in relation to the hollow section to be bent, three similar roller stations. The previously-mentioned modular construction, whereby the three mentioned roller stations are considered as a single module, will now be complemented by a further module which also consists of the three mentioned stations. There are then two similar modules, each consisting of three roller stations, positioned opposite to each other and fastened to the machine bed, and they provide the rolling- or bending gap for the hollow section to be bent.

With this kind of arrangement, it is possible to achieve a so-called alternate-roller-bending, so that the section may either be bent to the left or to the right with different radii.

In a third design of the invention, a so-called core-roller-bending is planned where again on one side of the section two or three roller stations are placed against the section, whereby the presence of two roller stations is preferred, of which the one roller station is the guide- and rolling station and the other is the support station, and that both of these stations are arranged opposite to a core bending station, which is provided with a rotationally driven core, on which a stationary clamp die is mounted, which accepts the front, free-end of the section to be bent. The section will be bent around the core with torque by means of an attractive force opposing the rotation, whereby the core is moving (winding process), and the previously-mentioned roller stations allow the section to be cleanly pressed onto the core within the range of bending.

In addition, it is planned in a further development, that in between the so-called roller stations, there will be one or more pressure dies arranged, to prevent the section to be bent from developing creases or deformities in between the so-called roller stations.

It shall be stressed again, that an important advantage of the invention lies in the fact, that practically, there are only two mutually opposite, rotationally-driven rollers, namely the rotationally-driven roller of the guide- and rolling station, which as a rule is the center roller of the three on one side positioned roller stations, while there is positioned on the opposite side to this guide- and rolling station, a rotationally-driven center roller of the center roller station. Because both of these rollers of the mutually opposite stations are rotationally-driven, an otherwise expensive push device can be done without, as it was described with the object of the older EP 492 211 B1. With this expensively designed push station, an extraordinary thrust in the range of several tons had to be produced, which was expressed in a correspondingly high cost of the machine. Also the EP 492 211 B1 was designed in a way that required two or more rotationally-driven rollers, which resulted in a correspondingly higher cost of the machine.

With this invention, there is now the advantage that a highly dimensioned push station is not needed, because the only thrust drive is effected by the mutually opposite rollers, whereby a high degree of friction is achieved, i.e. these rollers alone advance the section to be bent and an expensive push station is not required. Contrary to the conventional three-roller-machines, this invention has the advantage that the forward drive of the section to be bent can be purposefully adjusted by means of positioning the separate roller stations for the section on hand. This was not possible with previously known machines.

With the submitted invention, a carriage is also provided, which is put against the rear side of the section to be bent. The carriage is moveably driven on a carriage track on the machine bed. However, this carriage can only run along so that no thrust can be exerted on the section to be bent. This makes it possible to accurately measure along a straight measuring distance to determine the bending length of the hollow section. With this measuring system, which is contained in the carriage, it is now possible for the first time to bend to highly precise frame requirements, because this measuring system, which is contained in the carriage, is much more accurate than known measuring systems. Measuring systems of the known kind only measure the passing length of the section by means of a roller, friction-connected to the section.

One problem of the known measuring rollers was, that these measuring rollers could never be positioned within the neutral range of bending of the hollow section to be bent, which already caused the measuring results to be faulty. With this invention this is prevented, because the mentioned X-measuring system is contained in the carriage which is running along.

The mentioned carriage additionally serves the purpose that the section, if required, can be drawn in the direction opposite to the transport direction by use of the carriage, i.e. an attractive force is exerted on the section to be bent, counter to the drive of the roller bending stations, which is especially the case with the so-called core-roller-bending.

The mentioned carriage also serves to simplify the threading of a hollow section to be bent, into the roller bending stations, whereby this carriage then moves close to the threading station near the roller bending station and the hollow section to be bent is inserted from the outlet side into the roller bending station. From there, it is pushed through until it is caught by the carriage, whereupon it is drawn to the rear into its start-to-bending position.

The object of the submitted invention is not only derived from the object of the separate patent claims, but also from the combination of the separate patent claims to each other.

Everything in the documentation, including the summary, disclosed information and characteristics, especially spatial construction as depicted in the drawings, are claimed to be essential for the invention, as long as they are new with regard to the state-of-the-art, either separately or in combination.

Following is a more detailed explanation of the invention, providing representative drawings of various applications. In this manner, from the drawings and their descriptions, further characteristics essential to the invention and advantages of the invention are brought forth.

Figure 2:
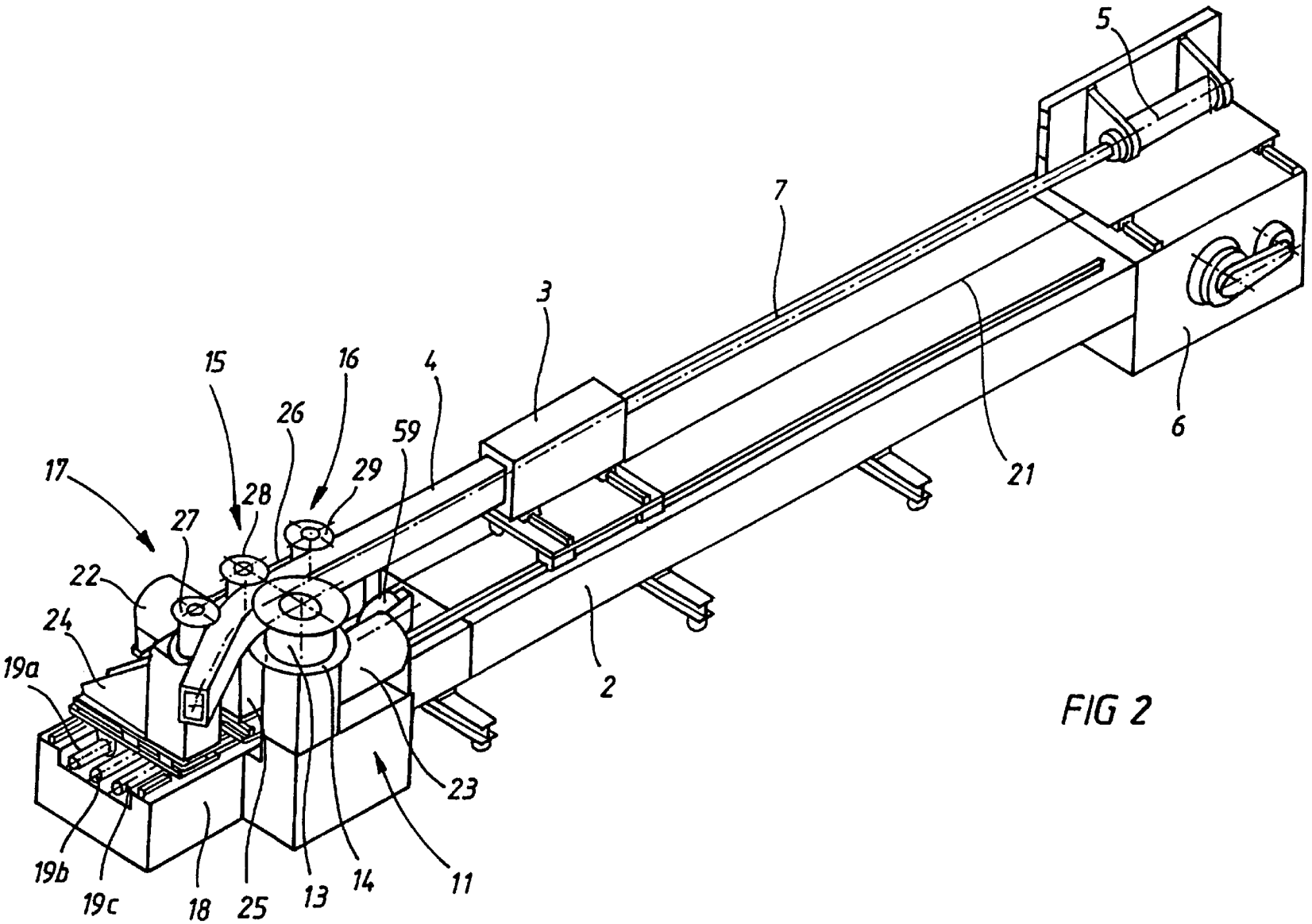
Figure 3:
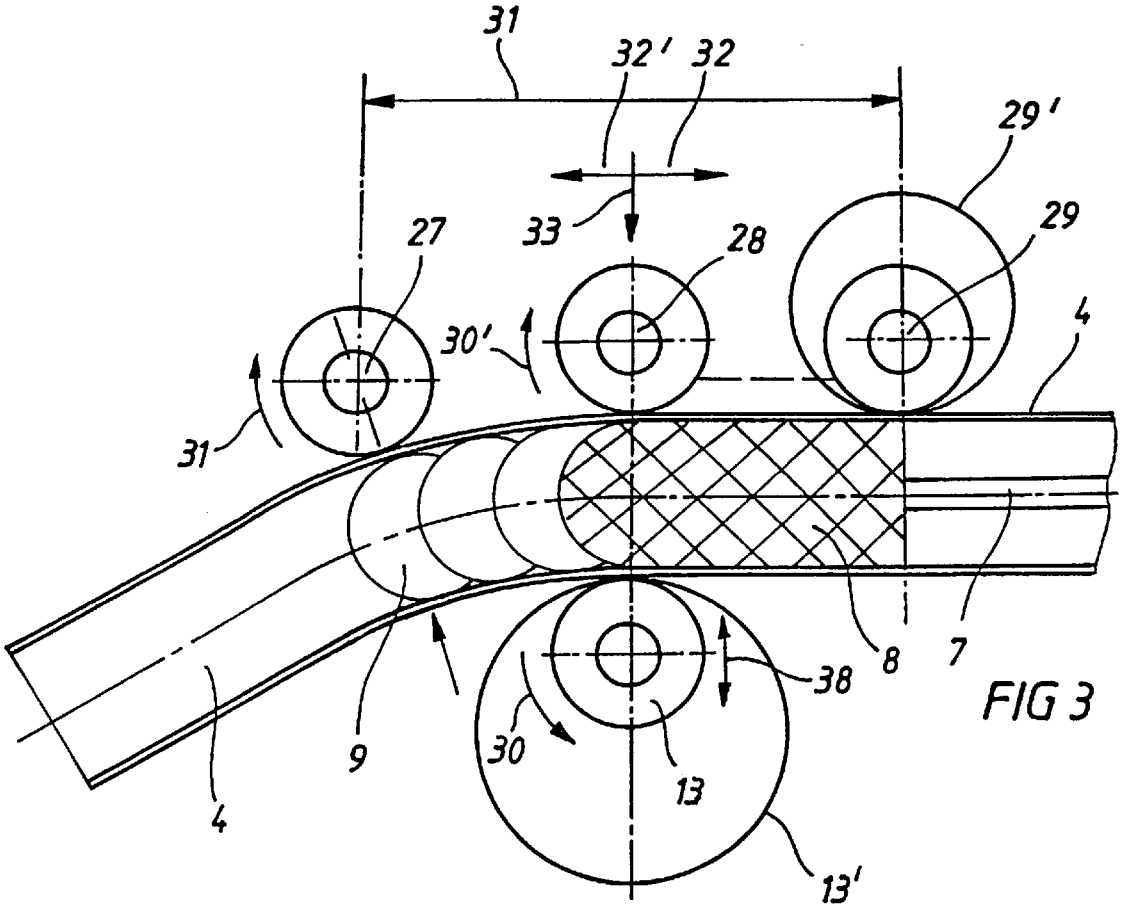
Figure 4:
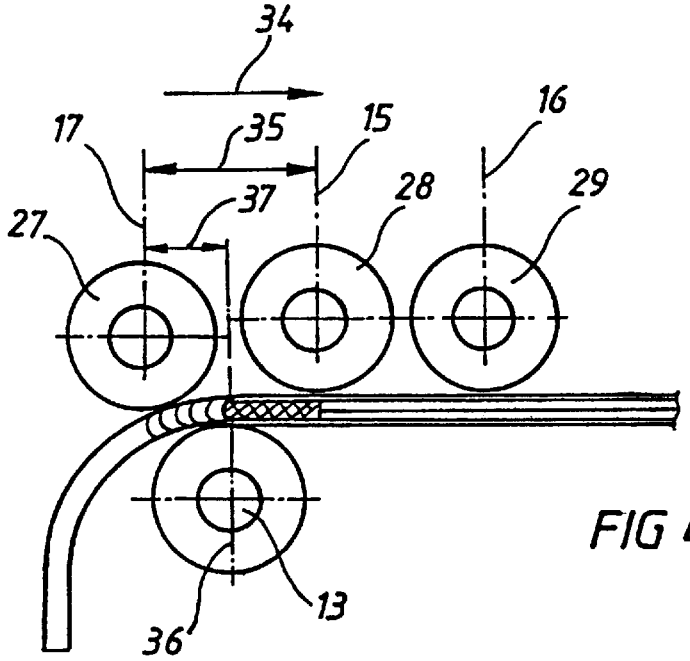
Figure 5:
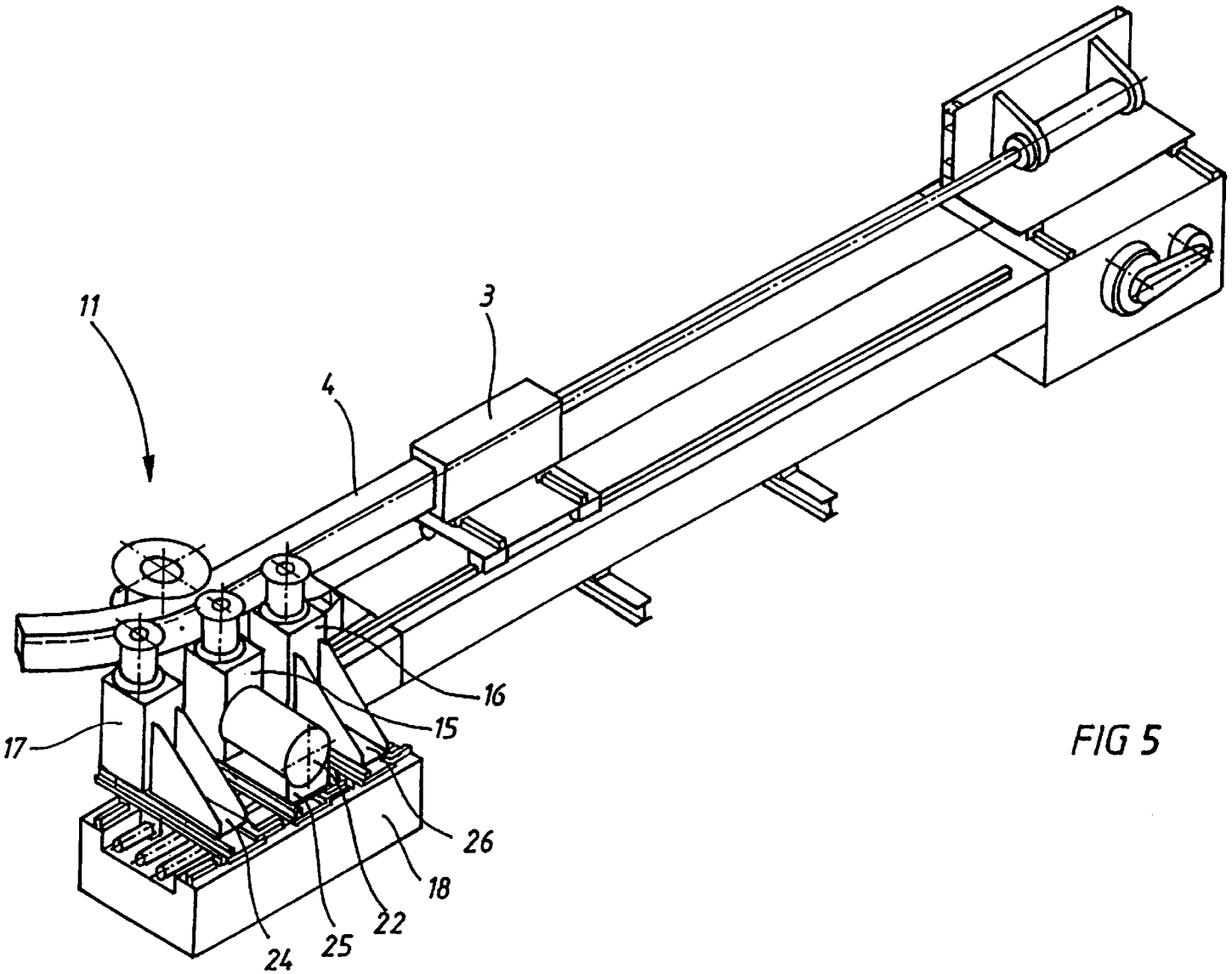
Figure 6:
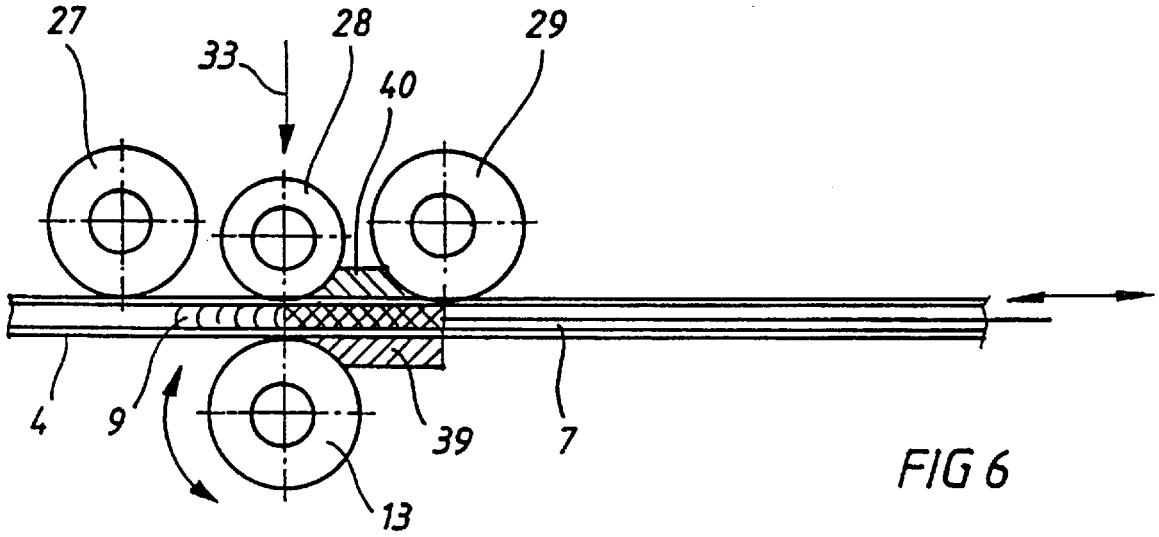

Shown are in:

FIG. 1: schematic of a device for roller bending of a hollow section in its first design form;

FIG. 2: Perspective view of the device of FIG. 1;

FIG. 3: A magnified view of the bending of a hollow section in the roller bending station;

FIG. 4 The same view as in FIG. 3 with changed positioning of the roller stations;

FIG. 5: A different design form as in FIG. 2 shows the machine bending to the right;

FIG. 6: A comparison of FIGS. 3 and 4—A more detailed drawing of a modified design form of the machine for roller bending.

Figure 7:
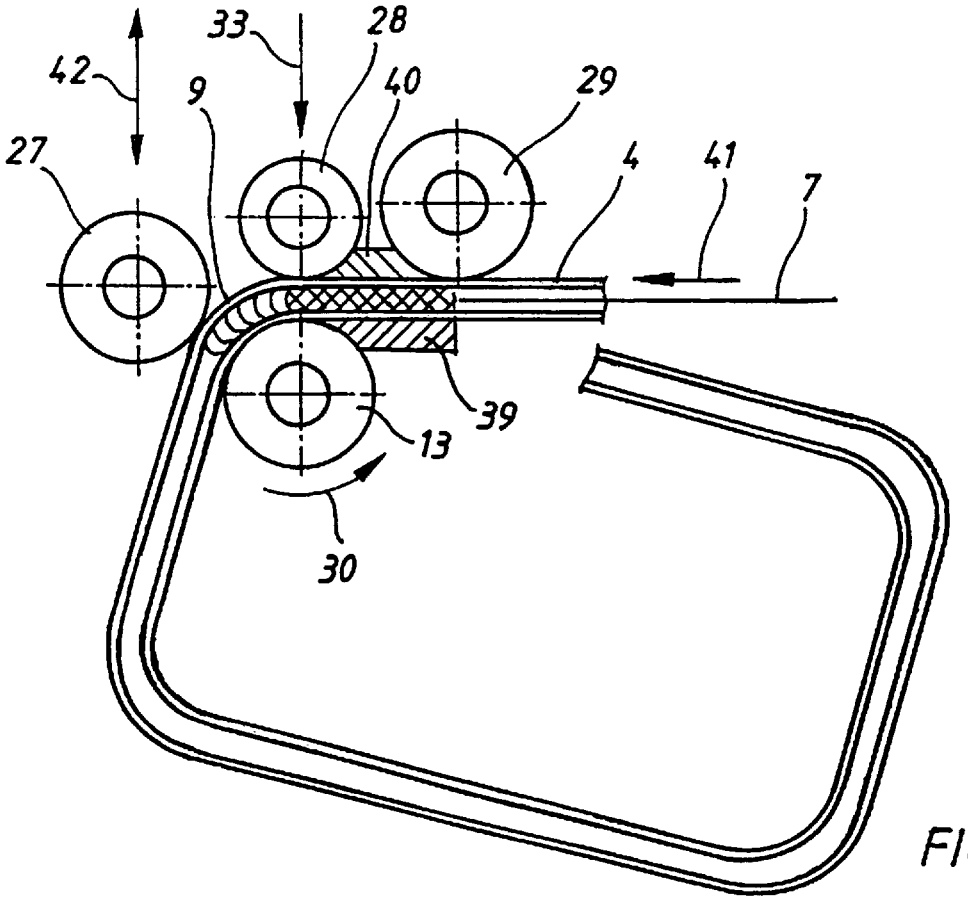
Figure 8:
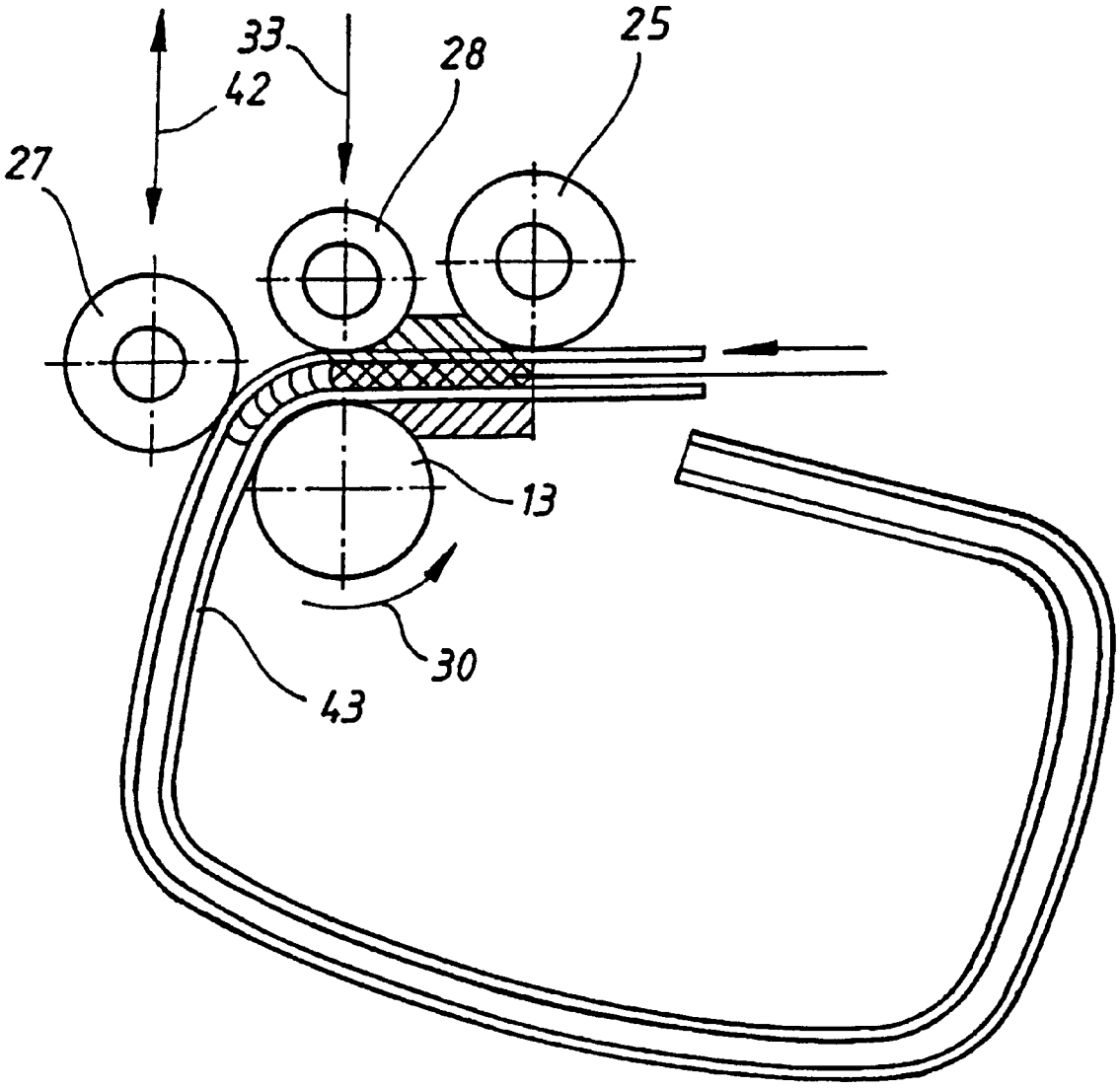
Figure 9:
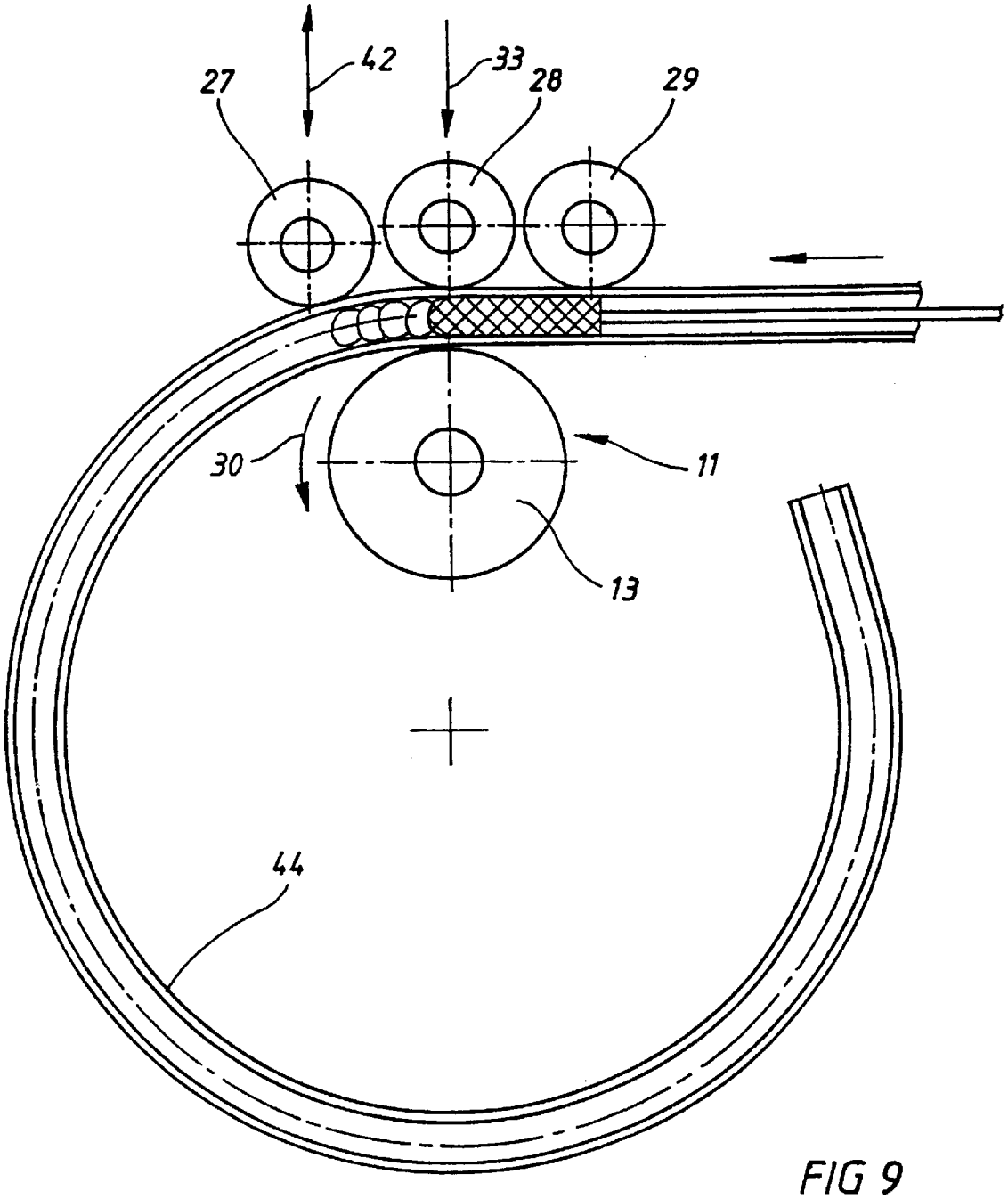
Figure 10:
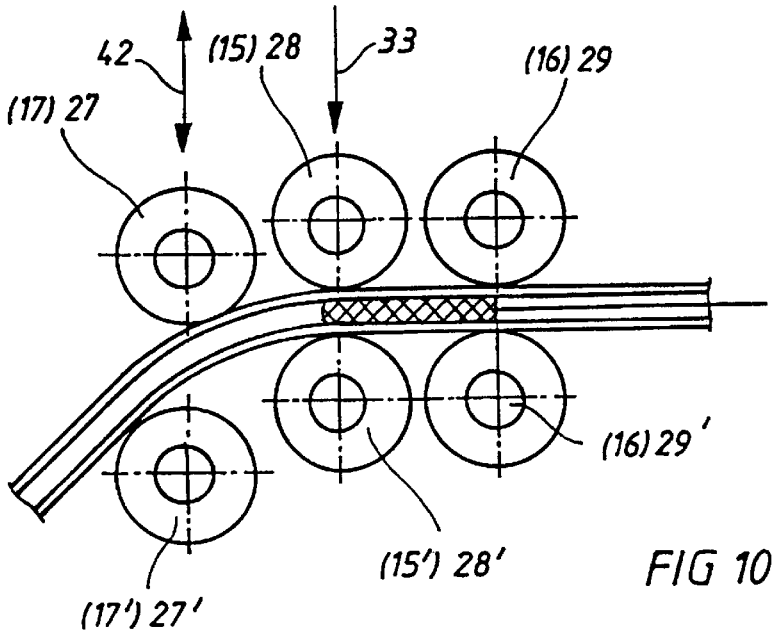
Figure 11:
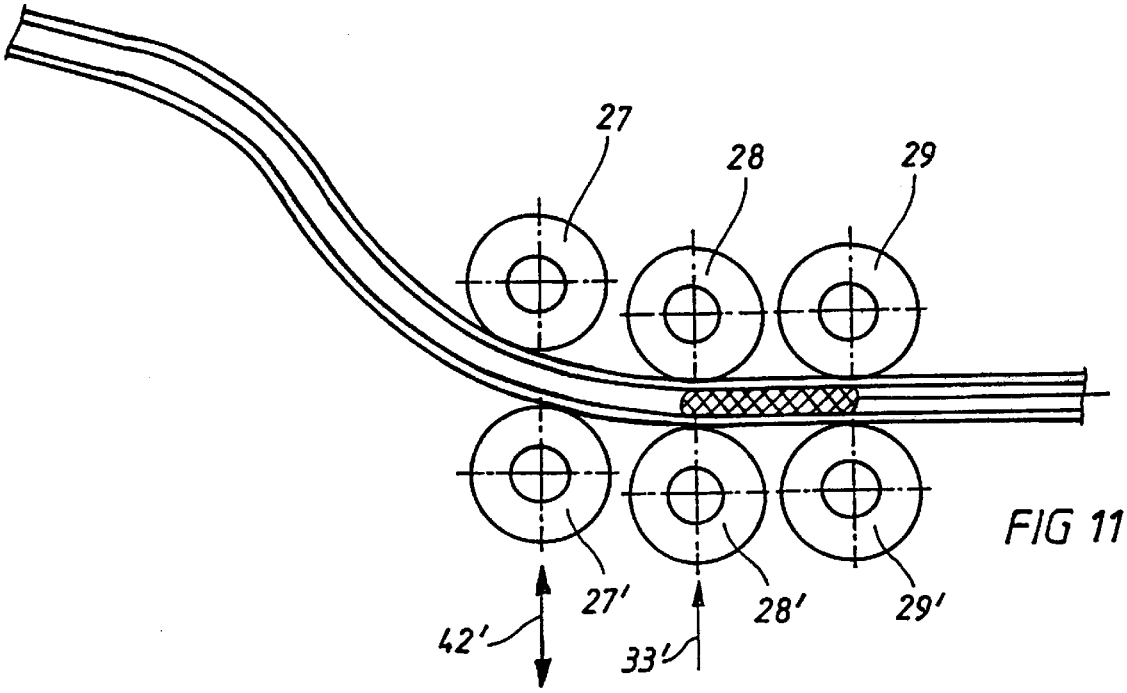
Figure 12:
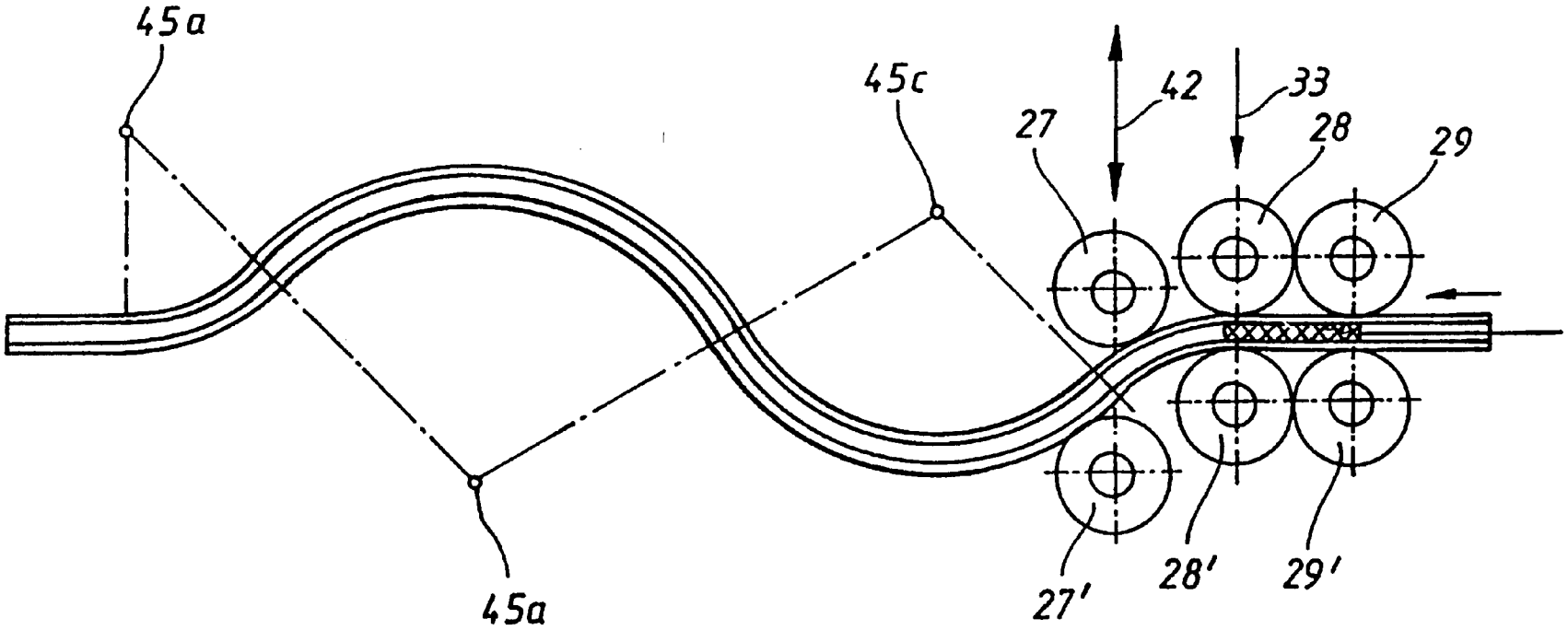
Figure 13:
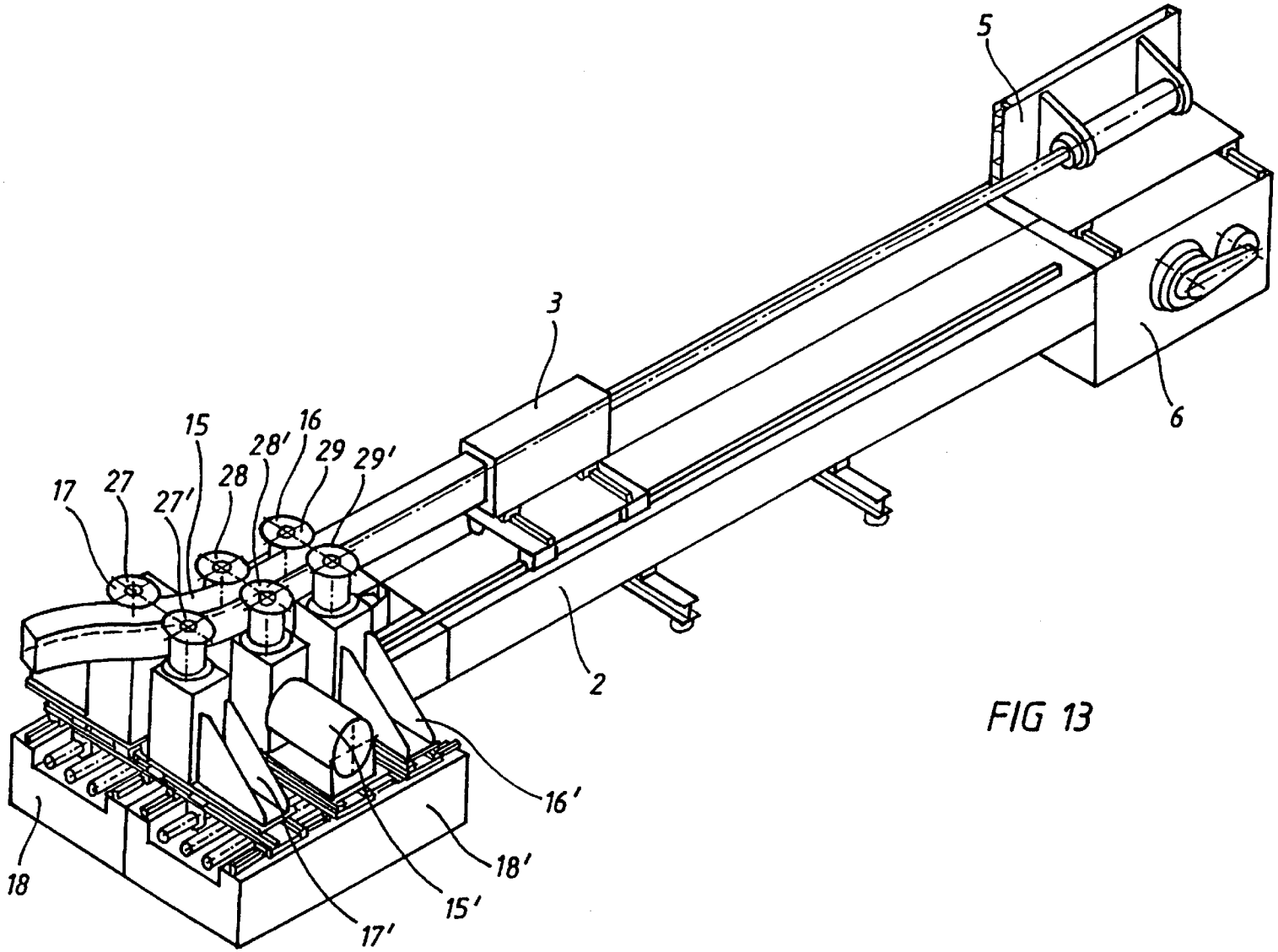
Figure 14:
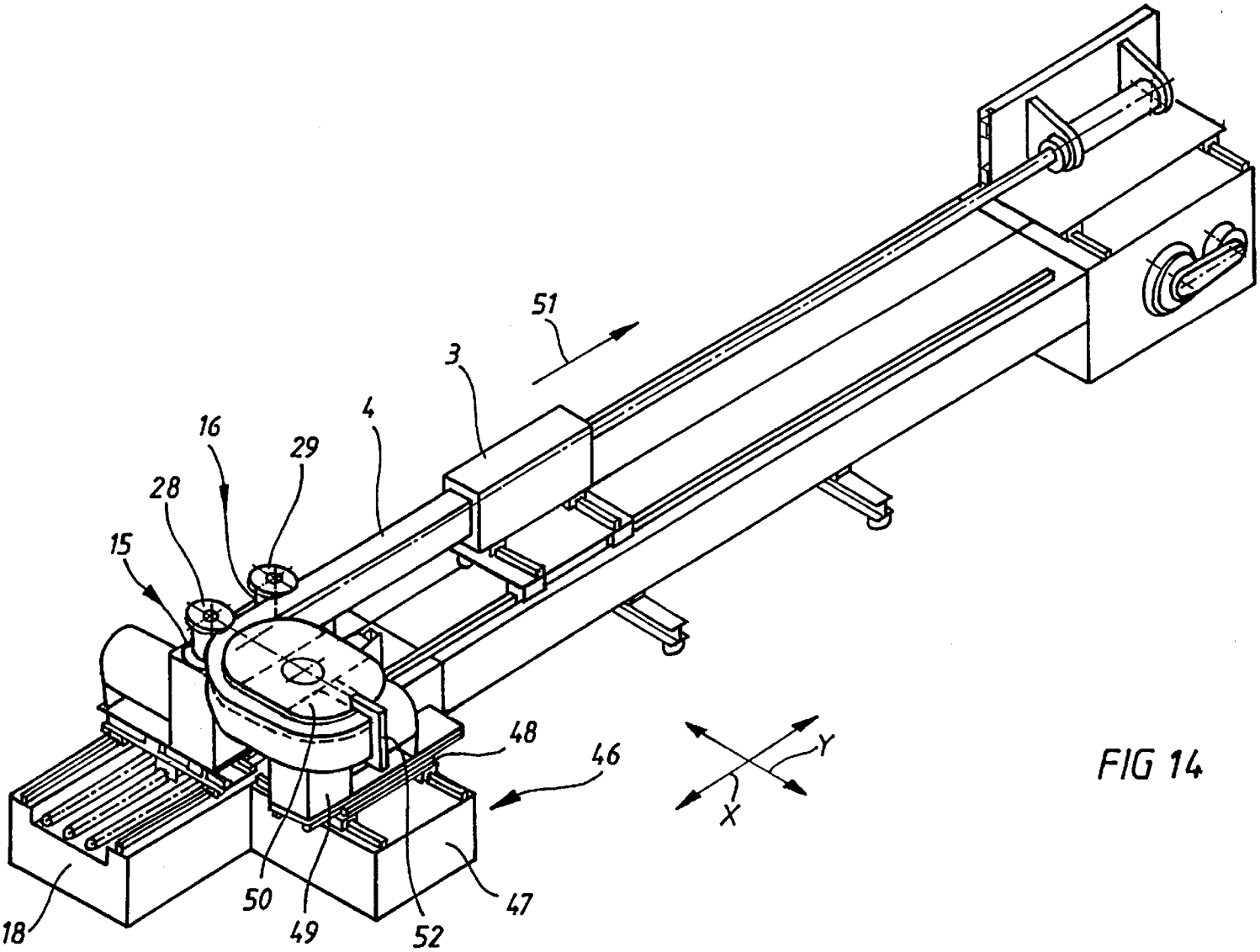
Figure 15:
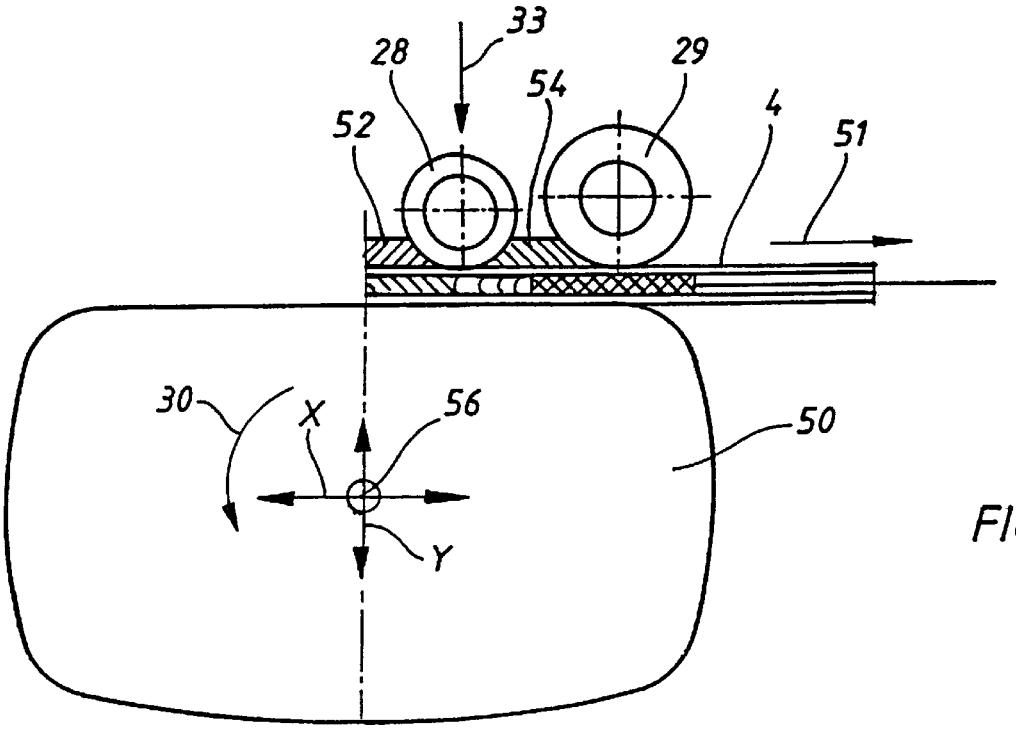
Figure 16:
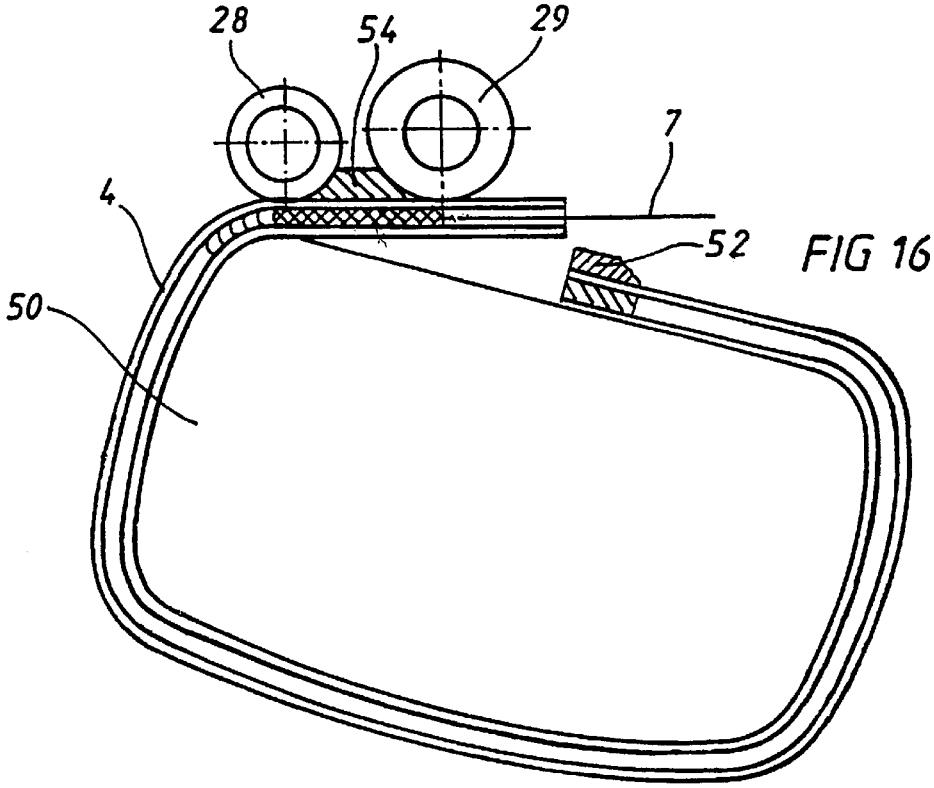
Figure 17:
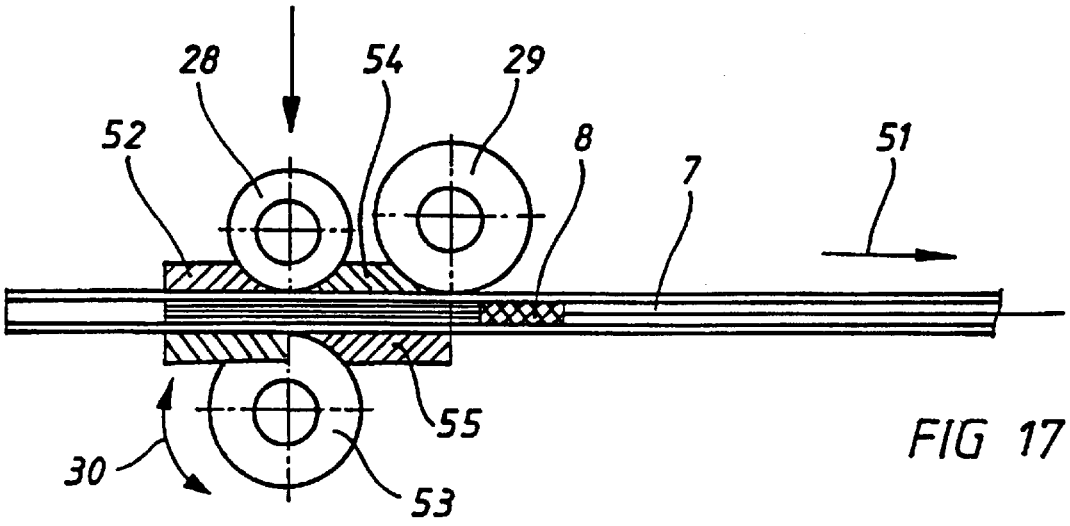
Figure 18:
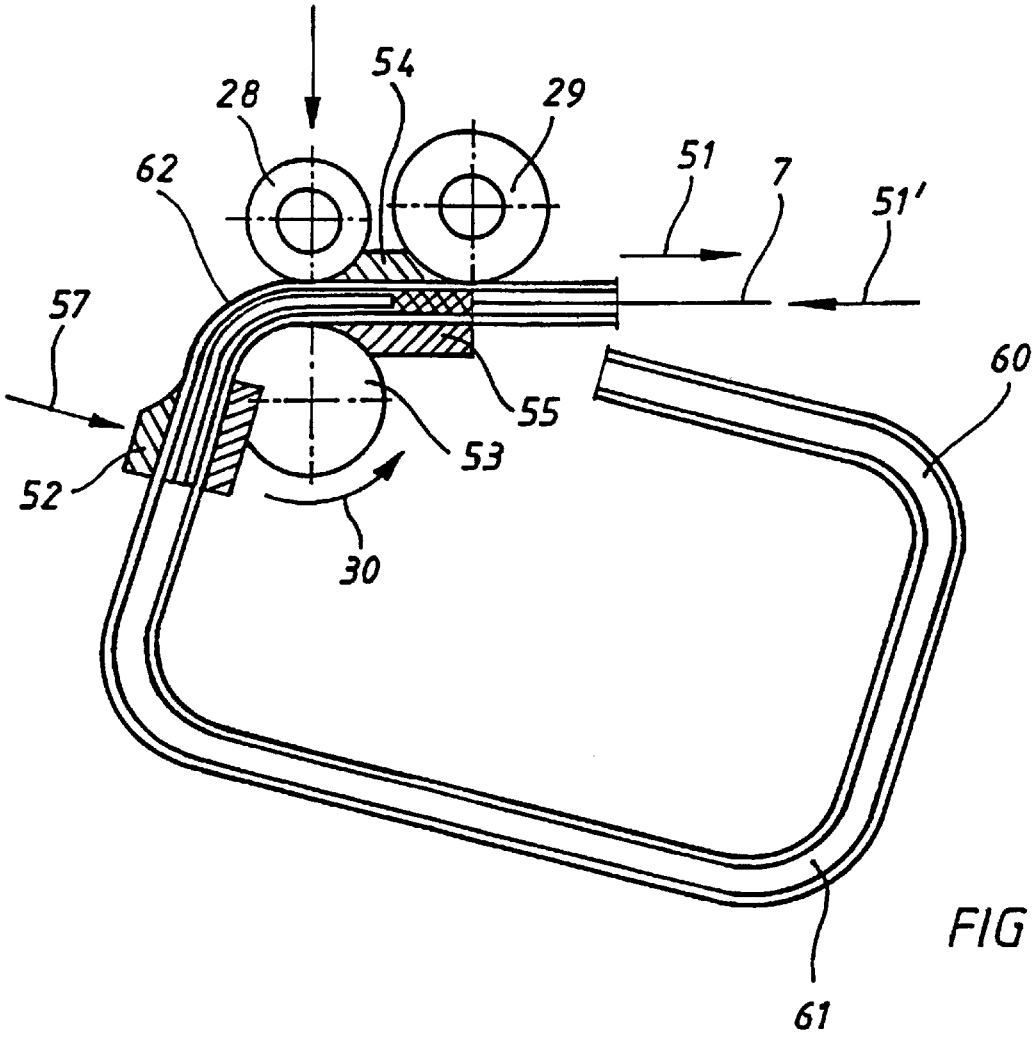
Figure 19:
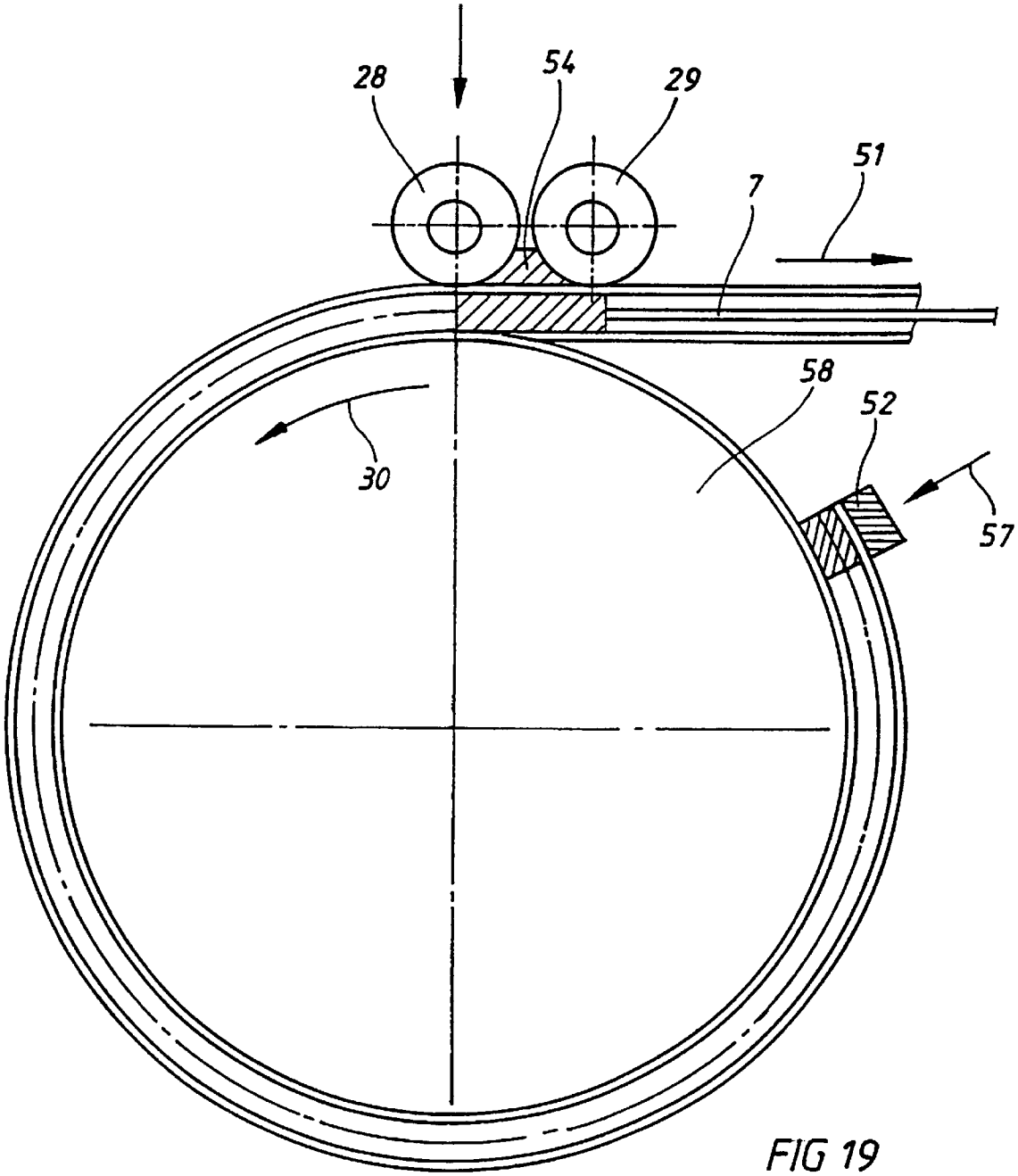

FIG. 7. View of FIG. 6 when bending a frame;

FIG. 8: The same view as in FIG. 7 when bending a frame with small and large bending radii;

FIG. 9: The function of the roller bending station when bending in a circle;

FIG. 10: The roller bending station according to the invention in the function of the alternate-roller-bending;

FIG. 11: The same view as in FIG. 10 but with more progressed bending;

FIG. 12: The same view as in FIGS. 10 and 11 with further progression of bending;

FIG. 13: A perspective view of a machine for performing the alternate-roller-bending;

FIG. 14: The perspective view of a machine for core-roller-bending;

FIG. 15: Schematic of the bending process with core-roller-bending with a machine, as in FIG. 14;

FIG. 16: Progression of bending on machine as in FIG. 15;

FIG. 17: Modification of a machine for core-roller-bending;

FIG. 18: The same view as in FIG. 17 with further progression in bending;

FIG. 19: Modified design with respect to FIGS. 3 and 4.

Figure 20:
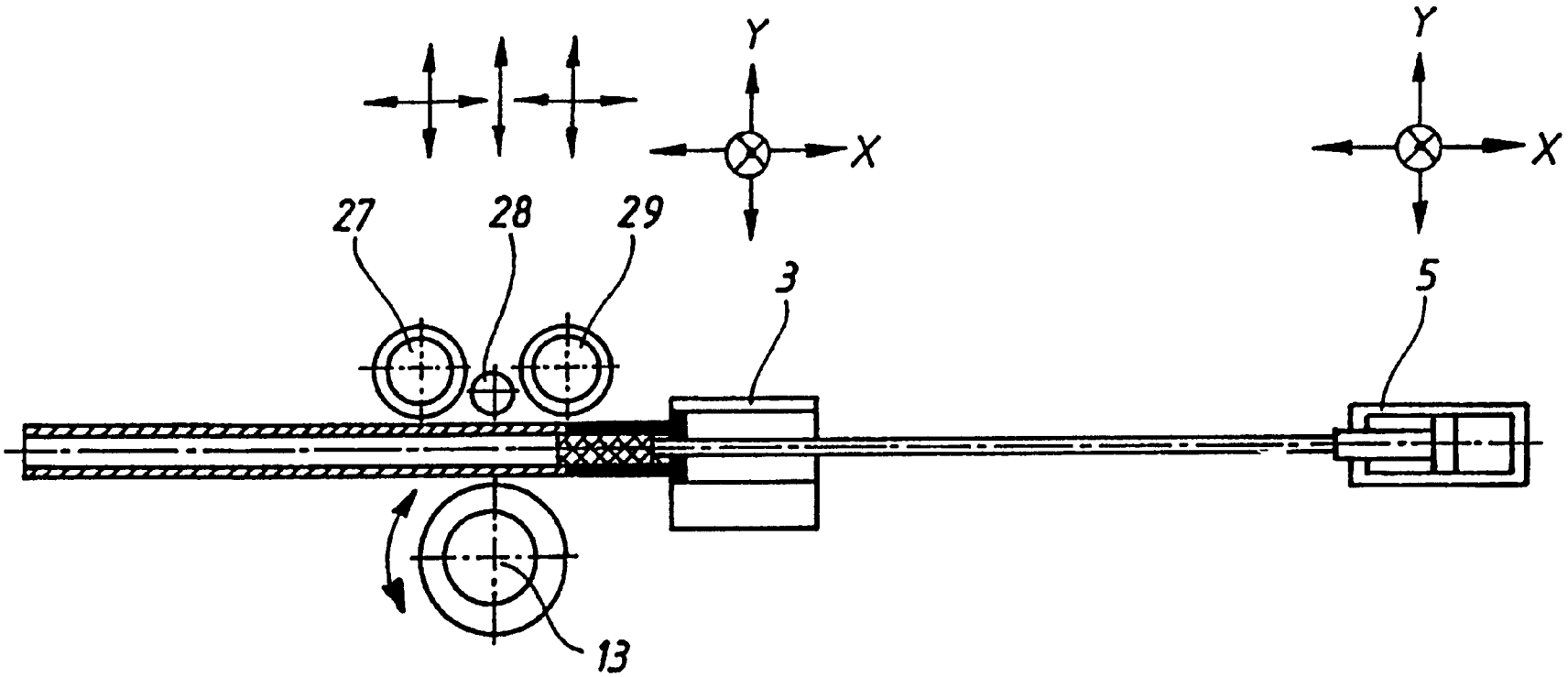

FIG. 20: A modification with respect to FIGS. 15 to 18 with a different kind of core, which is centrally-fixed.

According to the invention, the machine essentially consists of a roller bending station, designated in its entirety with 1, which consists of a row of roller stations. In the depicted example of the design, with regard to FIG. 1, the roller bending station 1 consists of a bending station 17, arranged at the end of the section to be bent 4, an adjoining guide- and roller station 15 positioned about in the middle, and a downward-positioned support station 16. These roller stations 15 to 17 are arranged on one side of the section to be bent 4, while on the opposite side is a provision for a center roller station 11, which consists of a single rotationally-driven center roller 13.

The section to be bent is herewith located parallel and above a carriage track 2, on which a carriage 3 is positioned, which is depicted movable in the X-direction. Inside the section 4 is a mandrel, which consists of a mandrel rod 7, which is connected to an assigned drive of mandrel station 5 by means of a clutch 10. In addition, there is a provision for a drive 6 for the carriage 3.

Located on the mandrel rod 7 is a mandrel shank on which are mounted a row of mandrel balls 9.

The shape and design of the mandrel is not decisive with regard to the invention; a simple mandrel shaft with balls or segments can also be used.

In FIG. 2, further details of machine construction with regard to FIG. 1 can be recognized.

Herewith, it is important that each roller station is located on a separate X-Y-carriage and that all of the roller stations are mounted in an adjustable and securable manner in the X-Y-direction on the machine body 18. The X-adjustment of the stations 15 to 17 in total, depends upon the size of the section. The movement in the Y-direction is necessary, in order to optimally perform the bending process. Herewith, for example, a slide 24 is assigned to bending station 17, with the slide being mounted in the X-Y-direction on the machine body 18.

A bending roller 27 is assigned to bending station 17, a rolling- and guide roller 28 is assigned to the guide- and rolling station 15 and a support roller 29 is assigned to the support station 16.

With the help of lead screws 19*a,* 19*b,* 19*c,* the separate stations 15–17 are adjustably constructed and secured in the X-direction. The adjustment drives for the adjustment of the separate rollers 27 to 29, respectively the stations 15–17, in the Y-direction are not further shown. This is effected, for example, by hydraulic cylinders or likewise by lead screw drives.

In the same manner, the center roller station 11 is also modularly constructed and attached to the machine body 18, whereby a drive 23 is provided for the rotation of the center roller 13 around the axis 12.

In FIG. 2, it is more clearly shown that the carriage 3 on the carriage track 2 is constructed to be movable in the X-direction, whereby a guide rope 21 is provided, and is guided over a pulley 59. This pulley is fastened to the machine body 18. The movement of carriage 3 is exactly concurrent with the drive of the rollers 28, 13, which are positioned opposite each other, so that the carriage 3 is simply running along with it.

Further, FIG. 2—and also on FIG. 5—depicts the drive 2 for the rotation of the center rolling- and guide rollers.

In comparison to FIG. 1, FIG. 3 shows a magnified view of the bending process, when the section is being bent to the left.

Herewith, in comparison to FIG. 3, it can be seen, that the spacing 31 between the modularly arranged stations 15–17, is adjustable and securable. It is further specified that the spacing 35 between the separate stations 15–17, is also individually adjustable.

The spacing adjustment 20 in the X-direction occurs—as previously stated—with the help of the individually activated slides 19*a,* 19*c.*

The center roller 13 consists, in the design shown, of a roller of smaller diameter, which is arranged between two discs 14 (FIGS. 1, 2) of larger diameter, whereby the discs, at least partially, overlap the section to be bent from above and below and the diameter of the center roller 13, engages on the side of the section to be bent.

Of course, the forms of all rollers shown, are fitted to the section to be bent, as required.

In a comparison between FIG. 3 and FIG. 4, it becomes apparent that the spacing 37 between the outer bending roller 27 and the center roller 13, positioned on the opposite side (and their axis 36), is constructed to allow adjustment. In this way, sections with large radii (FIG. 3) and large cross-sections or also—according to FIG. 4—sections with smaller radii and smaller cross-sections, can be bent as required.

With the design of FIG. 3, for example, a pressure 33 of about 50 kN is provided by the center rolling- and guide roller, with a section cross-section in the range of between 40 to 220 mm.

Herewith it is provided that this rolling- and guide roller 28 is driven in the direction of the arrow 30', while the center roller 13 is driven in the direction of the arrow 30.

FIG. 3 shows additionally that a relatively small center roller 13 can be exchanged with a suitably larger designed center roller 13'. In this manner, a better bending quality is achieved.

FIG. 4 also shows, that with such an arrangement, very tight radii can be bent with section cross-sections of, for example, 40 mm.

FIG. 5 shows the modular construction, where in comparison to FIG. 2, it can be seen that the modularly constructed stations 15–17 were merely moved from one side to the other side of the machine body, and that the center roller station 11 was also moved to the opposite side.

Here it can be further seen, that a slide 24 was provided for the bending station 17, a slide 25 for the guide- and rolling station 15 and a slide 26 for the support station 16. All the slides mentioned are designed to be adjustable and securable in the X-Y-direction.

With such an arrangement, as shown in FIG. 5, it is therefore possible to bend the section to be bent to the right.

Because of the shown measuring device, which is contained in carriage 3, and which allows an exact measurement of the section to be bent in the X-direction, it can be seen in FIG. 6 and FIG. 7, that frames with round comers can also be bent very exactly. Herewith it is essential, that between the rolling- and guide roller 28 and the support roller 29, two pressure dies 39, 40 are arranged opposite each other, which are designed to be stationary and which from both sides are placed to make friction-contact against the section cross-section to be bent. The lower pressure die 39 acts in this manner as a wiper die, and the upper pressure die 40 as a guide die.

As shown in FIG. 3 and FIG. 4, the various rollers of the various stations in the direction of the arrows 32 and 34 can be adjustably constructed. Additionally, it is shown in FIG. 3, that the mentioned stations are also adjustably constructed, in the direction of the arrow 38 (Y-direction), whereby it is sufficient in the depicted design example to construct the center station 11 only adjustable in the Y-direction (set-up direction 38), while an adjustment in the X-direction is not required. But this does not limit the invention; the invention can also be designed so that the center roller station 11 is adjustable and securable in X and Y.

FIG. 8 shows in comparison to FIG. 7, that on the basis of an exactly executed bending process, it is not only possible to bend such a frame with straight section segments but it is also possible to additionally provide for bent section segments 43.

Therefore it is possible, to very exactly bend a frame with small and large bending radii.

FIG. 9 shows in comparison to FIG. 8, that with an appropriate adjustment of the individual roller stations 15–17, in connection with the center roller station 11, a complete circle (bent section segment 44) can also be bent.

It is also possible to form this complete circle as a spiral, whereby it is additionally required that the already bent, free end of section segment 44 is upwardly deflected by means of a sheet-metal guide which is adjustable in the Z-direction, so that a spiral bend is made possible.

Here it is also shown, that in the adjustment directions 42 the various roller stations are designed to be adjustable and that further, a pressure 33 in the indicated direction of the arrow, is exerted by the center rolling- and guide roller 28 upon the section to be bent.

Because of the different sizes of the mutually-opposing rollers 13, 28, a friction is produced between the opposing form cross-sections on one and the same spot of the section, resulting in a flaring effect, which means that the section in the range of the rolling- and guide roller 28 will be more rolled out and thinned in this area than, for example, in the area of the center roller 13, on the opposing side.

Thereby, the bending process for the bending of the bent section segment 43, 44 is supported in a positive manner.

In the FIGS. 10 to 13, a so-called alternate-roller-bending is depicted, whereby it can be seen that because of the given modular construction the center roller station 11 has been removed and in its place another module, consisting of the stations 15–17, is positioned on the opposite side, as it is shown in the FIGS. 10 and 11. Dealing with the same modular parts, the newly-added parts are identified with an apostrophe.

Depending on set-up direction 42 and the post-application of pressure 33, a so-called alternate bending can now occur, which means it is possible to bend any desired, one behind the other, right or left oriented radii of any size.

Herewith, for example, it can be seen that the spacing between the oppositely-positioned bending rollers 27, 27', in the direction of the arrow 42 (direction of), is changeable and that depending on the desired bend, the spacing as well as the pressure of these bending rollers 27, 27' on the section to be bent, is designed to be adjustable. In this manner an exact guidance of the hollow section to be bent is accomplished.

FIG. 12 shows a further progressed state of the alternate bending process, where it can be seen that radii with different centers 45*a, b, c,* can be bent.

The advantage of the measures shown of all design examples is, that only one double drive is required, i.e. either only two rollers, opposing each other, are driven or only one roller is driven and the second drive is substituted by a push, which is exerted by the carriage 3 in the X-direction upon the section to be bent.

With this design it would only be required to rotationally drive the center roller 13 of the center roller station 11, while the carriage 3 in the X-direction only accomplishes the further drive upon the section.

With alternate bending according to FIGS. 10 to 13, the center roller 13 is then removed and in its place the rolling- and guide roller 28' is adjustably-mounted on the machine body 18. In addition to this roller, further rollers of the complementary stations, namely the bending roller 27' and the support roller 29', can be employed.

These rollers 27', 29', are necessary in any case, because these rollers must absorb the action forces originating from the bending process.

In the FIGS. 14 to 19 the so-called core-roller-bending will be described in more detail.

In a comparison of the representation in FIG. 14 with the representations in FIGS. 2, 5 and 13, the universal applicability of the invented machine can be recognized.

The same parts are identified with the same reference symbol.

It is important that only the two roller stations 15, 16 are present, to which the known and previously-described rolling- and guide roller 28 and the support roller 29, are assigned to.

In place of the previously-described center roller 13 and the center roller station 11 belonging to it, is a core bending station 46 with an assigned, rotationally-driven core 50. The previously-described bending roller 27 is not applicable.

Rotating with the core 50, which is adjustable in its axis 56 in the X-Y-direction and capable to be rotationally-driven in the direction of the arrow 30 and in the opposite direction, there is a connected clamp die 52, which grips the front, free end of the section to be bent.

The core bending station 46 consists of an X-slide 49 and a Y-slide 48, where both are adjustable, separate from each other, in the named directions and where both are mounted together on the machine bed 47, which is attached in a modular fashion to the machine body 18.

FIGS. 15 and 16 show further details of this device.

It can be seen that between the rollers 28, 29, a pressure- and guide die 54 is positioned, which makes friction-contact on one side of the section and in this manner provides for high-quality bending, because it causes the section to be bent 4 to be pressed against the outer circumference of the rotationally-driven core 50.

The bending action occurs herewith in the area of the axis of roller 28, whereby pressure is exerted in the direction of the arrow 33. This can especially be seen in FIG. 16.

This pressure has in turn a flaring effect on this side of the section, while the opposite side rests against the outer circumference of the core with a diminished rolling operation.

In addition, a pull is exerted by the carriage 3 upon the section to be bent, in the direction of the arrow 51, so that the section subject to the attractive tension is wound onto the core, while the core rotates in the direction of the arrow 30 and, if need be, with its axis 56 is constructed adjustable in the X-Y-direction during rotation.

Herewith, it is therefore essential that the carriage not only runs along and serves as a length measuring system, but that it can also be driven to move in the indicated direction of the arrow 51, in order to exert a tractive force in the direction of the arrow 51 upon the free end of the section to be bent.

The carriage therefore, exerts the described tractive force upon the total length of the section to be bent in the area of connection between the carriage 3 and the clamp die 52.

The described tractive force therefore will stretch the section.

The described selection process by the roller 28, and the described stretching process by the carriage 3, benefits the accuracy of bending with a minimum possible swelling of the section to be bent.

FIGS. 17 and 18 show the application of another core 53, but whereby otherwise the same explanations apply, which were given with regard to FIGS. 15 and 16. Here the core can be driven in the direction of the arrow 30 and in the counter direction. For the bending of the first corner 60, the section to be bent is positioned as shown in FIG. 18, where the first corner 60 is now already shown bent. In order to bend the next corner 61, it is planned that then the clamp die 52 opens, swings back into its starting position as shown in FIG. 17, and closes. The carriage 3 feeds the section forward, counter to the indicated direction of the arrow 51, to the beginning of the bend of corner 61; this corner will then be bent according to FIG. 18. This process will then be repeated to the last corner 62, which has just been bent as shown in FIG. 18.

FIG. 19 shows as a further design example the bending around a circular core 58, whereby the same explanations apply as previously-stated.

In order to achieve a complete 360 degree bend, it is planned that the clamp die 52 opens, returns a portion of the path, closes again and continues to bend the bend to 360 degrees and beyond, with a rotating core 58, whereby the already-close-to 360 degree-bent tube is guided on a sloping approach path over the bending station, in order to bend a complete circle or a spiral exceeding a complete circle.

This deflector is not shown in FIG. 19 for reasons of simplification. It is in addition simply represented that during the bending process the clamp die 52, separate from the core 58, is guided in the X-Y-direction and, if need be, is pressed against the core 58 in the direction of the arrow 57, radial to the core turning center.

With the given technical theory according to the submitted invention, an essential advantage is therefore realized, in that a multitude of different bending tasks can be accomplished with one and the same machine, whereby by reason of the modular arrangement, the different stations implement different bending processes, which proceed on one and the same machine.

In connection with FIG. 13, the term machine body 18 comprises the modular stations 15–17 mounted on to it. The right part of the total machine is represented in FIG. 13.

It is then, that an identical machine body 18' with the same mirror image constructed stations 15', 16', 17' exists, so that it can be spoken of being two machine bodies 18, 18' in total, with the modules mounted upon it, who can be supplemented with regard to each other in such a way that an alternate bending machine is achieved according to FIG. 13.

Out of this, the further advantage of the modular construction of the submitted invention is realized, in that not only separate modular stations exist, but that also the total machine body, with the identical modules mounted upon it, can be combined mirror image-like in a machine body and in this manner a new kind of bending machine comes into existence.

Within the meaning of this definition, the machine body 18, 18' can, therefore, be understood as a module.

A savings is then realized, that in this manner for such a double machine body 18, 18', only a single carriage track 2 with a carriage 3 and an assigned mandrel station 5 and a corresponding drive 6 is required.

In FIG. 20, it is shown as a further design example, that it is not necessary to construct the various rollers 27–29 of the individual roller stations 15–17 in the same size. In order to save space, it can be planned to construct the center rolling- and guide roller 28 in a smaller size and only have it adjustable in the Y-direction, while the other rollers 27 and 29 are designed to be adjustable in the X-Y-direction.

Because the rolling- and guide rollers 28 are kept smaller, it is possible that the slide upon which the roller is positioned and, therefore, the total guide- and rolling station 15, can be substantially reduced in size and, therefore, the spacing of the axes of the bending roller 27 and the support roller 29 with respect to the center roller 13, can be reduced significantly.

Further it is shown in this design example, that the carriage 3 is not only adjustable and easy to operate in the X-direction, but it can also be constructed to be additionally adjustable in the Y-direction.

The same applies to the mandrel station 5, which is also designed to be adjustable in the Y-direction and in the X-direction.

Drawing Legend (1) Roller bending station
(2) Carriage track
(3) Carriage
(4) Section
(5) Mandrel station (Hydraulic cylinder)
(6) Drive for carriage 3
(7) Mandrel rod
(8) Mandrel shank
(9) Mandrel ball
(10) Clutch
(11) Center roller station
(12) Driven axis
(13) Center roller 13'
(14) Disc
(15) Guide-and rolling station
(16) Support station
(17) Bending station
(18) Machine body 18'
(19) Lead screw 19 a, 19 b, 19 c
(20) Spacing adjustment
(21) Guide rope
(22) Drive for 15
(23) Drive for 11
(24) Slide for 17
(25) Slide for 15
(26) Slide for 16
(27) Bending roller 27'
(28) Rolling-and guide roller 28'
(29) Support roller 29'
(30) Direction of arrow 30'
(31) Spacing (variable)
(32) Direction of adjustment
(33) Pressure
(34) Direction of arrow
(35) Spacing
(36) Axis
(37) Spacing
(38) Direction of set-up
(39) Lower pressure die -continued

| Drawing Legend |
|---|
| (40) Upper pressure die |
| (41) Direction of arrow |
| (42) Direction of adjustment |
| (43) Bent section segment |
| (44) Bent section segment |
| (45) Center a, b, c |
| (46) Core bending station |
| (47) Machine bed |
| (48) Lower Y-slide |
| (49) X-slide |
| (50) Core |
| (51) Direction of arrow |
| (52) Clamp die |
| (53) Core |
| (54) Pressure and guide die |
| (55) Wiper die |
| (56) Rotary axis (core 50, 53) |
| (57) Direction of arrow |
| (58) Core |
| (59) Pulley |
| (60) Corner |
| (61) Corner |
| (62) Corner |

What is claimed is:

1. A bending apparatus, comprising:

a roller bending station for selectively bending a section into any one of a plurality of different bend profiles, the roller bending station having a bending area where a section is bent;

a guide assembly for guiding a section in a predetermined path into the bending area;

the bending station having a first, center roller on one side of a section in the bending area, and at least two additional rollers on the opposite side of the section;

at least the center roller comprising a driven roller; and the additional rollers each being independently adjustable in an x and y direction.

2. The apparatus as claimed in claim 1, wherein there are three additional rollers, the additional rollers comprise a central, guide and rolling roller opposing said first, center roller, a bending roller positioned downstream of the guide and rolling roller in the bending area, and a support roller positioned prior to the guide and rolling roller in the section path.

3. The apparatus as claimed in claim 2, wherein the guide and rolling roller is a driven roller.

4. The apparatus as claimed in claim 2, wherein each additional roller is adjustable in an x and y direction independently from the other two additional rollers.

5. The apparatus as claimed in claim 1, including a common machine body on which the bending station is mounted, the bending station comprising a plurality of separate roller stations, each roller station having at least one roller, and each roller station being adjustably and removably mounted on the machine body and being modularly exchangeable for modifying the bend profile.

6. The apparatus as claimed in claim 1, including a mandrel positioned in the bending area for supporting a section to be bent on the inside.

7. The apparatus as claimed in claim 1, including a movable carriage for supporting an end of a section remote from the bending area.

8. The apparatus as claimed in claim 1, including a core bending station removably mountable on the machine body.

9. The apparatus as claimed in claim 8, wherein the core bending station includes a rotationally driven core and a clamp die for gripping the section to be bent.

10. The apparatus as claimed in claim 1, wherein the bending station includes at least one pressure die located adjacent one of the rollers and adapted to make contact with an outer surface of a section to be bent.

11. A bending apparatus, comprising:

a machine bed along which a section to be bent can be guided;

a roller bending assembly mounted on the machine bed for selectively bending a section into any one of a plurality of different bend profiles;

a guide assembly for guiding a section on a predetermined path into the roller bending assembly;

the roller bending assembly comprising a plurality of separate, modularly exchangeable roller stations each removably mounted on the machine bed, the roller stations comprising a first center roller station positioned in a bending area on one side of a section to be bent, and at least two additional roller stations positioned on the opposite side of the section to be bent;

each of the roller stations having a roller acting against a portion of a section to be bent;

at least one of the rollers comprising a driven roller;

the roller of one of the additional roller stations comprising a guide and rolling roller positioned opposite the roller of the center roller station; and an adjustment device for pressing the guide and rolling roller against the section to be bent with a predetermined driving force, whereby thrust drive is effected by the mutually opposing rollers.

12. The apparatus as claimed in claim 11, wherein the guide and rolling roller and the roller of the central roller station are both rotationally driven, whereby thrust drive is effected by the mutually opposing rollers.

13. The apparatus as claimed in claim 11, wherein there are three additional rollers, the additional rollers comprising the guide and rolling roller opposing the roller of said central rolling station, a bending roller positioned downstream of the guide and rolling roller in the bending area, and a support roller positioned prior to the guide and rolling roller in the section path.

14. The apparatus as claimed in claim 13, wherein the guide and rolling roller is a driven roller.

15. The apparatus as claimed in claim 13, wherein each additional roller is adjustable in an x and y direction independently from the other two additional rollers.

16. The apparatus as claimed in claim 11, including a mandrel positioned in the bending area for supporting a section to be bent on the inside.

17. The apparatus as claimed in claim 11, wherein the bending assembly comprises a core bending station removably mountable on the machine body.

18. The apparatus as claimed in claim 17, wherein the core bending station includes a rotationally driven core and a clamp die for gripping the section to be bent.

19. The apparatus as claimed in claim 11, wherein the bending station includes at least one pressure die located adjacent one of the rollers and adapted to make contact with an outer surface of a section to be bent.

20. A method of bending a section into any one of a plurality of different predetermined bend profiles, comprising the steps of:

selection of a predetermined combination of separate roller stations for co-operating to achieve a predetermined bend profile, including a central roller station for positioning on one side of a section to be bent in a bending area, and at least two additional roller stations for positioning on the opposite side of the section to be bent;

mounting each of the roller stations separately on a common machine body;

adjusting the relative positions of the roller stations according to the predetermined bend profile;

introducing the section to be bent into the bending area between the roller stations;

positioning one of the additional roller stations such that a guide roller of the additional roller station presses against the section with a predetermined driving force and is positioned opposite an opposing roller of the central roller station and rotatably driving both of the opposing rollers so as to apply a thrust drive to the section to be bent; and starting the bending process.

21. A method of bending a section into any one of a plurality of different predetermined bend profiles, comprising the steps of:

selection of a predetermined combination of separate roller stations for co-operating to achieve a predetermined bend profile, including a central roller station for positioning on one side of a section to be bent in a bending area, and at least two additional roller stations for positioning on the opposite side of the section to be bent;

mounting each of the roller stations separately on a common machine body;

adjusting the relative positions of the roller stations according to the predetermined bend profile;

introducing the section to be bent into the bending area between the roller stations;

starting the bending process; and moving at least some of the roller stations relative to the machine body and relative to other roller stations during the bending process.

22. A method of bending a section into any one of a plurality of different predetermined bend profiles, comprising the steps of:

selection of a predetermined combination of separate roller stations for co-operating to achieve a predetermined bend profile, including a central roller station for positioning on one side of a section to be bent in a bending area, and at least two additional roller stations for positioning on the opposite side of the section to be bent;

mounting each of the roller stations separately on a common machine body;

adjusting the relative positions of the roller stations according to the predetermined bend profile;

introducing the section to be bent into the bending area between the roller stations;

starting the bending process; and supporting the section to be bent on a movable carriage for guiding the section into the bending area, wherein the carriage is not driven and the section is moved by operation of the bending process, and measuring the movement of the carriage in order to determine the length of the bent section segments.

23. A method of bending a section into any one of a plurality of different predetermined bend profiles, comprising the steps of:

selection of a predetermined combination of separate roller stations for co-operating to achieve a predetermined bend profile, including a central roller station for positioning on one side of a section to be bent in a bending area, and at least two additional roller stations for positioning on the opposite side of the section to be bent;

mounting each of the roller stations separately on a common machine body;

adjusting the relative positions of the roller stations according to the predetermined bend profile;

introducing the section to be bent into the bending area between the roller stations;

starting the bending process; and supporting the section to be bent on a movable carriage for guiding the section into the bending area, moving the section in a first direction as a result of operation of the bending stations in the bending process, and driving the carriage in order to exert a force on the section in a direction counter to the first direction during the bending process.

* * * * *